US007028362B2

(12) United States Patent
Davallou

(10) Patent No.: US 7,028,362 B2
(45) Date of Patent: Apr. 18, 2006

(54) TOES AND CALLUS CLEANER

(76) Inventor: Harry Davallou, P.O. Box 2431, La Jolla, CA (US) 92038

( * ) Notice: Subject to any disclaimer, the term of this patent is extended or adjusted under 35 U.S.C. 154(b) by 255 days.

(21) Appl. No.: 10/605,409

(22) Filed: Sep. 29, 2003

(65) Prior Publication Data

US 2005/0066460 A1 Mar. 31, 2005

(51) Int. Cl.
*A47K 3/022* (2006.01)
*A61H 33/00* (2006.01)

(52) U.S. Cl. ..... 15/104.92; 15/210.1; 4/606; 4/622; 601/136

(58) Field of Classification Search ..... 15/104.92, 15/210.1; 4/606, 622; 601/136, 138
See application file for complete search history.

(56) References Cited

U.S. PATENT DOCUMENTS

| | | | | |
|---|---|---|---|---|
| 4,918,779 | A | 4/1990 | Burns | |
| 5,398,363 | A * | 3/1995 | Medearis et al. | 15/104.92 |
| 5,813,078 | A * | 9/1998 | Hogan, Sr. | 15/160 |
| 5,983,433 | A | 11/1999 | Chapman | |
| 6,405,390 | B1 | 6/2002 | Kuen | |
| 6,530,096 | B1 | 3/2003 | Mayhew et al. | |
| 6,584,636 | B1 | 7/2003 | Schlem | |
| 6,893,508 | B1 * | 5/2005 | Andrews | 134/6 |

* cited by examiner

*Primary Examiner*—Randall Chin

(57) ABSTRACT

Disclosed is an improved sanitary foot washing device that is designed for washing feet in both private and public locations. This device has been created for the purposes of reducing the occurrences of foot mediated transmutable diseases that are prevalent in public locations like public showers and swimming pools. The device consists of a support having a system that administers fluid like detergents to scrubbing cords that enable the cleaning of all areas of the foot specially the regions between the toes. The support also has scrubbing sheets that enable the cleaning of the regions under feet as well as the regions on the sides of feet.

18 Claims, 4 Drawing Sheets

TOES AND CALLUS CLEANER

BACKGROUND OF INVENTION

The present invention relates to an improved foot spraying and scrubbing device that is designed to conveniently and safely clean difficult areas of the foot such as between the toes. This invention has been designed in order provide a simple and fast means of cleaning feet in order to reduce the prevalence of commonly transmitted diseases such as fungal and bacterial infections that often occur in private bathrooms between family members and also in public places like gym lockers, showers and swimming pools. The present invention is a simple device for the general purpose of scrubbing feet, especially in regions between the toes. Due to its simplicity it is very amendable as a cost effective apparatus that can be purchased by any household or public facility.

In the prior art, foot cleaning devices have been disclosed. U.S. Pat. No. 4,918,779 claims a device that consists of a foot-controlled spray with brushes. In this device, the spray and brush comes from a horizontal position where the spray flows through the brush. U.S. Pat. No. 6,584,636 discloses a device that contains both vertical and horizontal brushes and wash feet using a stream of water coming from a source beneath the foot, which like the U.S. Pat. No. 4,918,779 patent, uses a steam of fluid that flows through the brush. Further the U.S. Pat. No. 6,584,636 patent is designed to wash shoes outdoors.

As opposed to the '636 patent, the present claimed invention is designed to wash feet in private or public bathrooms, gymnasiums or swimming pools. Further as opposed to the U.S. Pat. No. 6,584,636 patent, the stream of fluid can be a detergent that flows from a source that is from above the foot. The present invention also has attached removable scrubbing cords and callous sheets that are used to scrub the feet and are separated from the fluid source.

Using a fluid source that pours detergent from a position that is above the foot and is separated from the brushing mechanisms enables a more sanitary washing device. This is due to limited direct contact of feet to the position where the detergent is poured. This feature makes the present invention very suitable for public locations having large numbers of people where the frequency of contagious foot disease is high.

SUMMARY OF INVENTION

The present invention relates to an improved foot cleaning device that can both apply fluid and scrub the feet. The present invention can be used in private bathrooms or public areas such as sports arenas and swimming pools. The present invention includes the following interrelated components and aspects:

(a) In a first aspect, the present invention consists of a base, a front portion and a rear portion. The front portion is connected with the rear portion at the top of the present invention by forming an angle sufficient to form a stable structure. The present invention is stabilized using a bar that is positioned at the base of the device that attaches the front portion to the rear portion.

(b) The base has a top surface and a bottom surface. The top surface will have ridges or a similar rough surface so that a person will not slip when washing the feet. The bottom surface will have suction cups used to fix the device to distinct positions on the bathroom floor such as the surface of the shower or bath tub. In the case of public facilities the device can be fixed to a define location by means of bolting the device down by securing bolts through the base. The recommended use of the invention is to use within reach of a handle such as one attached to a bathroom wall.

(c) An embodiment of the present invention is to wash the bottom, front and back of the feet as well as the regions between the toes. Removable rough surface sheets are attached to the rear position of the present invention; the sheets are used to scrub the bottom and sides of the feet. Scrubbing cords are positioned in the front position of the present invention. The cords are used to scrub the top, sides and regions between the toes of the feet. The cords are removable so that they can be replaced when they become worn out. The cords will also be available in three sizes: men, women and children.

(d) The fluid pours onto the scrubbing cords and the removable rough surface sheets from a fluid container tube that is positioned above the scrubbing cords. The fluid container pivots to form an angle sufficient to pour detergent either on the scrubbing cords or the rough surface sheets. The fluid container tube also rotates in either a clockwise or counterclockwise motion in order to pour detergent onto either the scrubbing cords or rough surface sheets.

(e) The fluid is a detergent and is distributed into the container tube using an input nozzle that is positioned within the fluid container tube.

BRIEF DESCRIPTION OF DRAWINGS

FIG. 4 shows an exploded view of the top part of FIG. 1.

DETAILED DESCRIPTION

Figure 1:
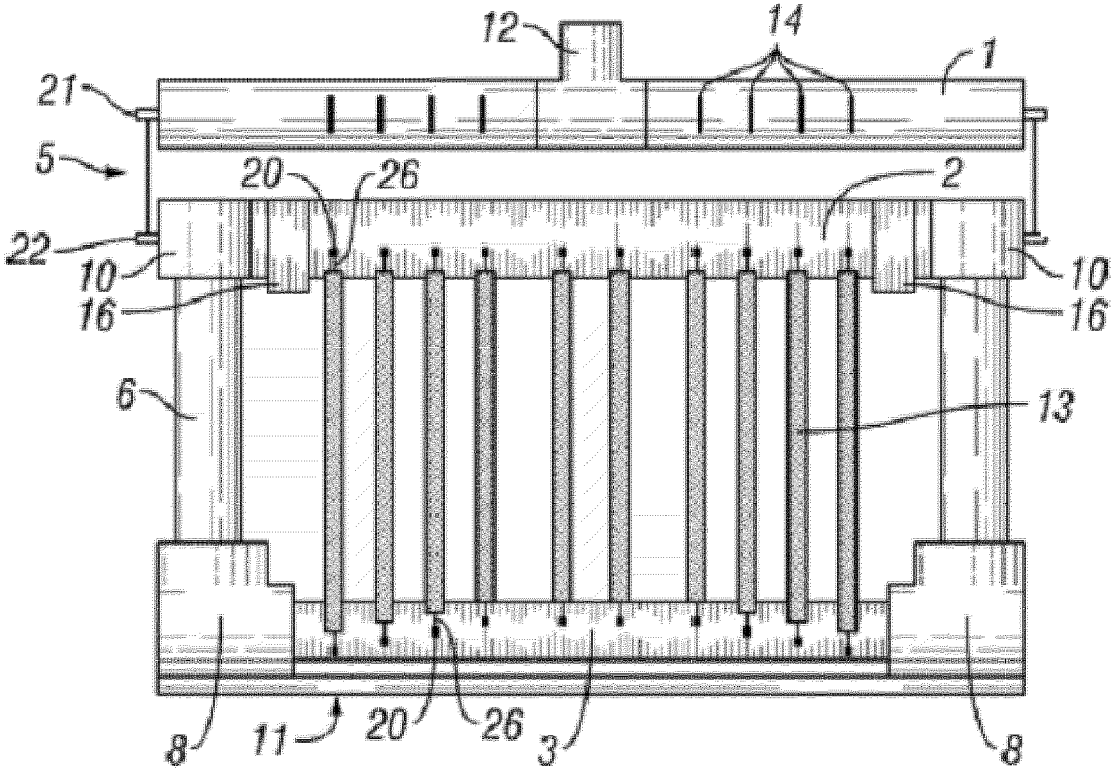
FIG. 1 shows the frontal view of the front of the present invention.
Figure 2:
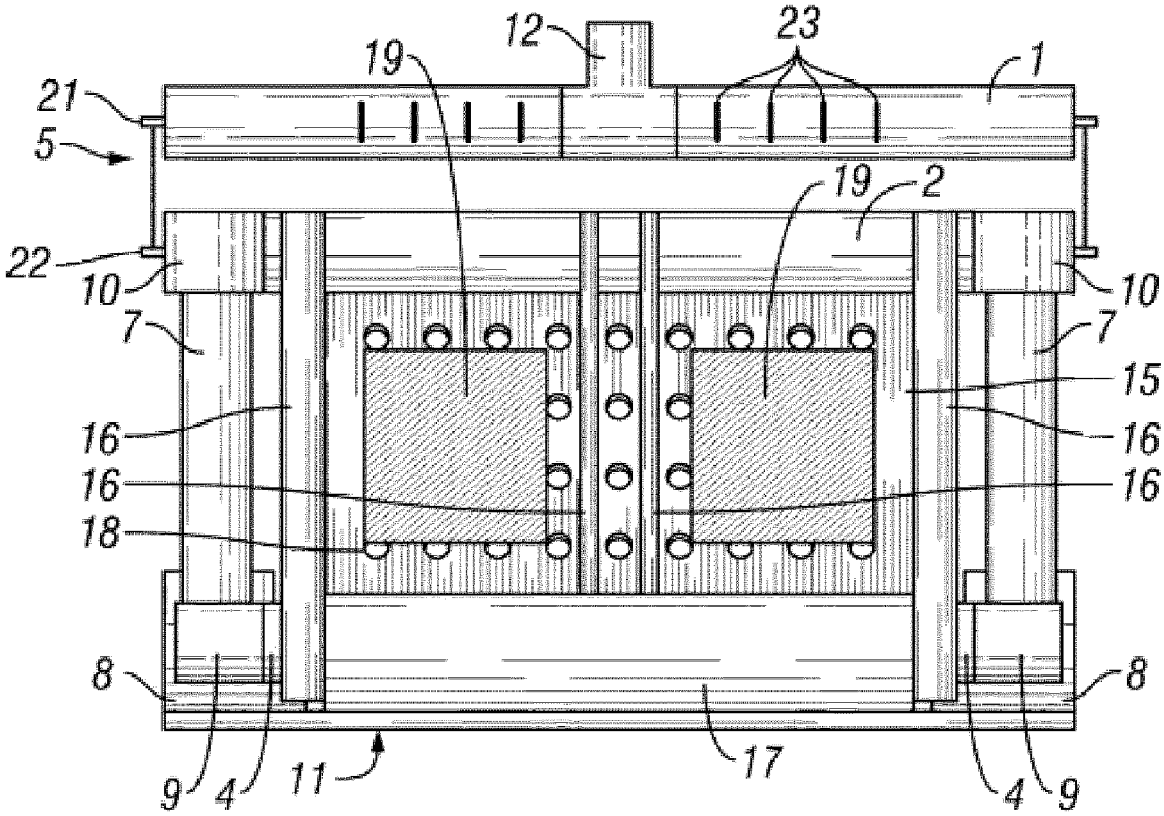
FIG. 2 shows the frontal view of the rear of the present invention.
Figure 3:
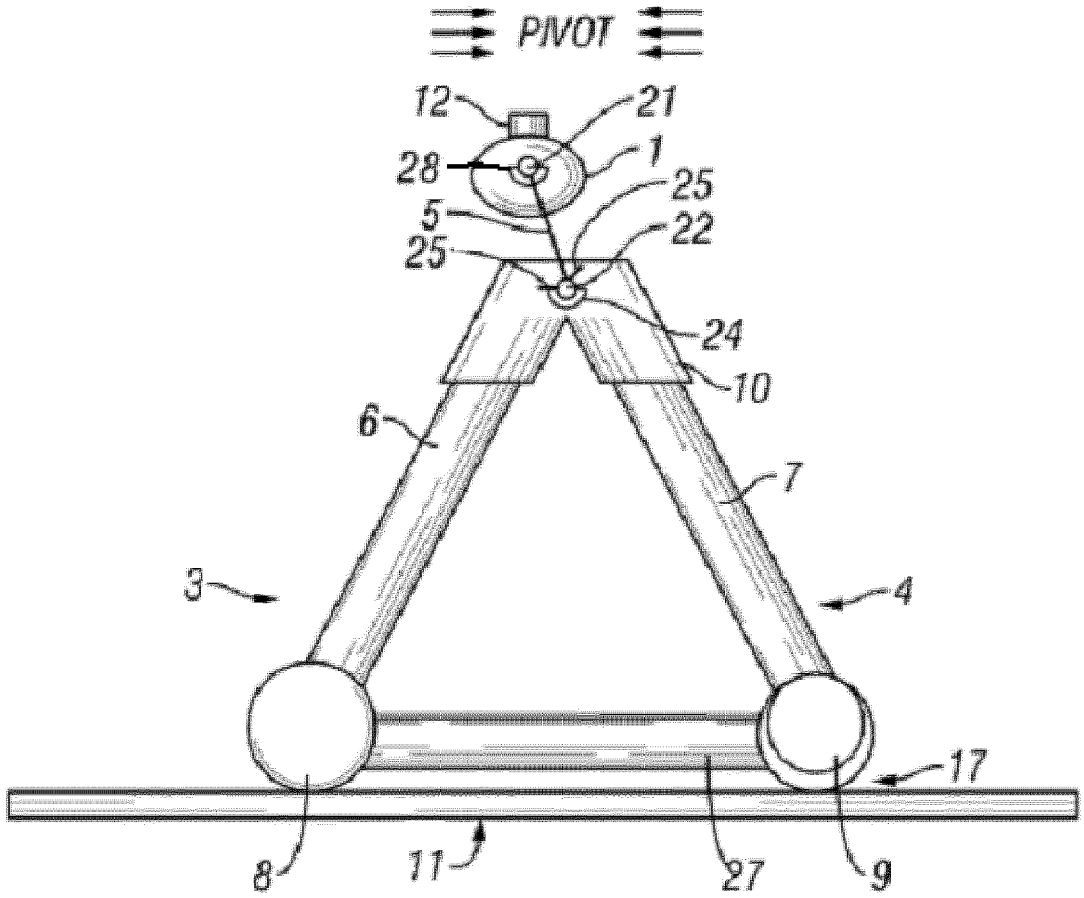
FIG. 3 shows the side view of the present invention.

FIGS. 1–3 by reference describe a first embodiment of the present invention. The invention consists of a container tube 1 positioned above a top horizontal support linkage 2, a front support linkage 3 and a back support linkage 4. The linkages 2, 3, 4 can be one continuous tube or a plurality of connecting tubes. Illustrated in FIG. 3, the structure is stabilized using a bar 27 that connects the front support linkage 3 to the back support linkage 4. A preferred embodiment is to have the bar 27 be connected to the middle of the front and back support linkages 3, 4.

The container tube 1 is connected to the horizontal support linkage 2 by means of pivot connectors 5. The pivot connectors 5 have an attached circular top end 21 and an attached circular bottom end 22. The attached circular bottom end 22 is housed into bottom grooves 24 that enables the container tube 1 to pivot. The attached circular bottom end 22 has attached pins 25 to enable the container tube to move to fixed positions in the bottom grooves 24 that either enables fluid to pour over scrubbing cords 13 (illustrated in FIG. 1) or rough surface sheets 19 (illustrated in FIG. 2). The attached circular top ends 21 are housed in top grooves 28 in order to allow rotational movement of the container tube 1. The attached circular top end 21 and the groove 28 are connected to the container tube 1 at a position of approximately ½ radius distance above the center of the container tube 1 in order to cause the container tube to rotate to a position where fluid is not poured onto either the scrubbing cords 13 or rough surface sheets 19 when force is released.

A preferred embodiment is that the top groove 28 is in an open position enabling the container tube 1 to be easily removed so that the user can refill the tube with detergent. This embodiment would be used for a private location. Another preferred embodiment is that the top groove 28 is in a closed position that locks the container tube 1 so that the container tube 1 cannot be removed. Situations like this would require the lock to be opened by an operator who has a key that causes the top groove 28 to be put into an opened position. This embodiment would be especially useful in public locations.

The support linkages 3, 4 are connected to the top horizontal support linkage 2 by means of front legs 6 and rear legs 7. The front legs 6 are connected to the front support linkage 3 by means of front bottom connectors 8. The rear legs 7 are connected to the back support linkage 4 by means of rear bottom connectors 9. The legs are connected to the top horizontal support linkage 2 by using top connectors 10 to make an angle that is sufficient to form a stable structure such as a 45 degree angle (illustrated in FIG. 3). The device is positioned above a base 11. The base 11 is rigid having a surface connection means underneath. For private locations, the connection means are rubber suction cups. For public locations, the connection means are screws or any device that causes permanent attachment.

With reference to FIG. 1, fluid is administered into the container tube 1 by means of a manifold nozzle 12. The nozzle 12 is connected to the container tube 1 and can contain a removable cap. The fluid passes from the container tube 1 onto scrubbing cords 13 out of outlet orifices 14 that are positioned along the side of the container tube 1. A preferred embodiment is that there are overhangs at the bottom end of the outlet orifices 14 to guide the pouring of fluid onto the scrubbing cords 13. The scrubbing cords 13 are connected to the top horizontal support linkage 2 and the bottom front horizontal support linkage 3 so that they are easily removable so that they can be replaced. The container tube 1 is positioned above the top horizontal support linkage 2 in a sufficient angle to cause detergent to be poured on top of the scrubbing cords 13.

The scrubbing cords 13 can be composed of porous or fibrous material to enable the absorption of liquid such as cloth or plastic. The cords 13 can also be elastic. A preferred embodiment is that the cords 13 are composed of double waved fibrous nylon. Another preferred embodiment is that the scrubbing cords 13 are removable so that they can be replaced when they are worn out. Another preferred embodiment is that the scrubbing cords 13 can vary in size in order to accommodate different sizes of feet.

The scrubbing cords 13 have structured ends 26 that can attach to the top horizontal support linkage 2 and the bottom horizontal support linkage 3. Preferably the structured ends 26 of the scrubbing cords have a slender tubular shaft with a flat head having a larger diameter than the tubular shaft. This type of structure can securely fasten to irregular shaped holes 20 positioned along the linkages 2, 3 where one part of the hole 20 is large enough for the flat head to enter into whereas the other part of the hole 20 is small enough to retain the flat head once the structured end 26 is directed into the smaller part of the hole 20. This will securely attach the scrubbing cords 13 into horizontal linkages 2, 3. On the top horizontal support linkage 2 the irregular shaped holes 20 are aligned evenly across the linkage 2. On the bottom horizontal support linkage 3 the irregular shaped holes 20 are aligned whereby the holes 20 towards the ends of the present invention are positioned lower down the side of the bottom horizontal support linkage 3 while the holes residing closer to the center of the present invention are increasingly positioned higher along the side of the bottom horizontal support linkage 3. This enables the spaces between the toes to be comfortably scrubbed simultaneously.

Figure 4A:
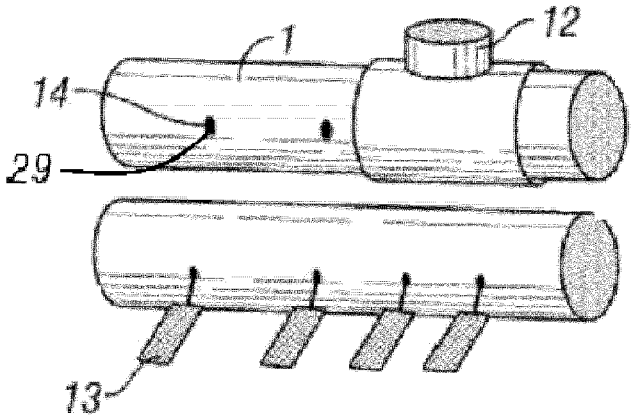
FIG. 4A shows the perspective view of the present invention when liquid is not added to the scrubbing cords.
Figure 4B:
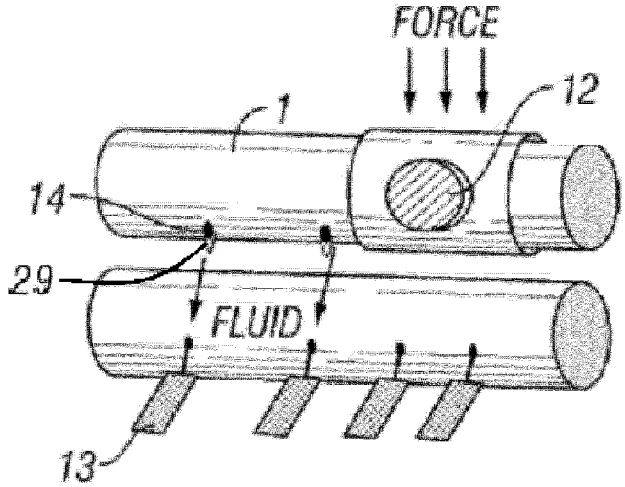
FIG. 4B shows the perspective view when liquid is added to the scrubbing cords.

FIG. 4 illustrates describes a portion of the container tube 1, horizontal support linkage 2 and nozzle 12 and the mechanism for depositing the fluid onto the scrubbing cords 13 in detail. Downward rotational force is applied by the operator onto the container tube 1 that causes the container tube 1 to rotate downward whereby fluid is poured through the outlet orifices 14 onto the scrubbing cords 13. A preferred embodiment is that the bottom parts of orifices 14 have overhangs 29 that guide the pouring fluid onto the scrubbing regions. In FIG. 4A, the overhangs 29 are displayed in a horizontal position and FIG. 4B illustrates the overhangs 29 being in a vertical position as they are used to guide the pouring of fluid onto the scrubbing cords 13. When the downward force is released the container tube 1 rotates back to its original position whereby the remaining fluid is retained in the container tube 1. This is done by gravity force due to the top groove 28 illustrated in FIG. 3 being approximately one half radius distance from the center of the container tube 1 end.

In FIG. 2, a support sheet 15 is fixed in parallel with the rear legs 7 using vertical braces 16 and a horizontal brace 17 that connects the support sheet 15 to the top horizontal support linkage 2 and the bottom rear support linkage 4. The support sheet 15 contains a plurality of orifices 18 in order to permit the passage of fluid and air. The support sheet 15 can be composed of plastic or rubber. Connected to the support sheet 15 are two rough surface sheets 19 that contain a coarse surface in order to enable the object to be cleaned such as a foot to be scrubbed. The rough surface sheets 19 can be connected to the support sheet 15 using any suitable adhesive such as glue. The rough surface sheets 19 can be removable. The rough surface sheets 19 are sufficient to remove callous" on feet. The container tube 1 can be pivoted into a position above the rough surface sheets whereby upon downward rotation of the container tube 1 detergent is poured out of orifices 23 onto the rough surface sheets 19. A preferred embodiment is that there are overhangs at the bottom end of the outlet orifices 23 to guide the pouring of fluid onto the rough surface sheets 19.

I claim:

1. An improved sanitary foot cleaning device, comprising:

(a) a support having a fluid pouring system including one top horizontal linkage, one front bottom horizontal linkage and one rear bottom horizontal linkage, said top linkage is connected to said bottom front and rear linkages by means of front legs and rear legs;

(b) said support having a bar that connects said front bottom horizontal linkage to said rear bottom horizontal linkage;

(c) said support having said front bottom horizontal linkage and said rear bottom horizontal linkage being connected to a base;

(d) said support having a support sheet interposed between said top horizontal linkage and said rear bottom horizontal linkage;

(e) said support having scrubbing surfaces including a plurality of scrubbing cords, said scrubbing cords interposed between said top horizontal linkage and said front bottom horizontal linkage, scrubbing sheets being attached to said support sheet;

(f) said fluid pouring system including a horizontal tube having a nozzle, said nozzle used for inlet of fluid into said fluid pouring system;

(g) said horizontal tube having ends and having top grooves connected to said ends in order to attach connectors, said grooves having a front side and a rear side;

(h) said top linkage having ends and having bottom grooves connected to said ends in order to attach said connectors;

(i) said horizontal tube connecting to said top linkage by said connectors enabling said horizontal tube to pivot in order to pour fluid onto said scrubbing surfaces;

(j) said fluid pouring system including outlet orifices, said outlet orifices used for outlet of fluid from said horizontal tube onto said scrubbing surfaces upon actuating downward rotational movement of said horizontal tube.

2. The invention of claim 1, wherein said connectors have a top end and a bottom end, said top end having an attached top circular fixture and said bottom end having an attached bottom circular fixture.

3. The invention of claim 2, wherein said top circular fixtures are housed in said top groove.

4. The invention of claim 2, wherein said bottom circular fixtures are housed in said bottom grooves whereby said horizontal tube pivots to a position so that fluid can be poured onto said scrubbing cords upon said front pins resting on front sides of said grooves.

5. The invention of claim 2, wherein said bottom circular fixtures are housed in said bottom grooves whereby said horizontal tube pivots to a position so that fluid can be poured onto said scrubbing sheets upon said rear pins resting on rear sides of said grooves.

6. The invention of claim 1, wherein said bottom circular fixtures having a front pin and a rear pin.

7. The invention of claim 1, wherein said linkages of said support are pipes consisting of plastic, metal or rubber.

8. The invention of claim 1, wherein said linkages of said support are rods consisting of plastic, metal or rubber.

9. The invention of claim 1, wherein said container tube consists of plastic, metal or rubber.

10. The invention of claim 1, wherein said support sheet consists of plastic, metal or rubber.

11. The invention of claim 1, wherein said scrubbing cords are attached to said top horizontal linkage by a first connection means, said first connection means aligned evenly across said top horizontal linkage.

12. The invention of claim 1, wherein said scrubbing cords are attached to said bottom horizontal linkage by a second connection means, said second connection means aligned whereby outermost connection means are positioned lower down said bottom horizontal linkage where inner connection means are positioned higher along said bottom horizontal linkage.

13. The invention of claim 1, wherein said scrubbing cords consists of flexible porous material capable of absorbing fluid; said cords having sufficient width to enable scrubbing between toes of a foot.

14. The invention of claim 1, wherein said scrubbing cords consists of flexible fibrous material capable of absorbing fluid; said cords having sufficient width to enable scrubbing between toes of a foot.

15. The invention of claim 1, wherein said scrubbing sheets being two sheets spaced at a location to enable a left sheet to scrub a left foot and a right sheet to scrub a right foot.

16. The invention of claim 1, wherein said scrubbing sheets consists of plastic, rubber or fibrous material.

17. The invention of claim 1, wherein said base consists of a rigid material and having flexible suction cups underneath.

18. The invention of claim 1, wherein said base consists of a rigid material and having means to connect to a surface.

* * * * *